US005533857A

United States Patent [19]

Ferrone

[11] Patent Number: 5,533,857

[45] Date of Patent: Jul. 9, 1996

[54] TURNTABLE FOR MANIPULATING PAPER ROLLS

[76] Inventor: Rock A. Ferrone, 1885 Main St., Pittsburgh, Pa. 15215

[21] Appl. No.: 393,374

[22] Filed: Feb. 23, 1995

Related U.S. Application Data

[63] Continuation-in-part of Ser. No. 35,442, Mar. 23, 1993, abandoned.

[51] Int. Cl.[6] ..... A47B 11/00

[52] U.S. Cl. ..... 414/757; 108/139; 414/911; D7/501

[58] Field of Search ..... D7/501; 108/139; 414/910, 911, 754, 757

[56] References Cited

U.S. PATENT DOCUMENTS

| | | | |
|---|---|---|---|
| 846,948 | 3/1907 | Richter | D7/501 |
| 1,689,160 | 10/1928 | Siegrist | 108/139 |
| 1,732,113 | 10/1929 | Van Der Meer | 108/139 |
| 1,814,998 | 7/1931 | Yocum | 108/139 |
| 3,302,594 | 2/1967 | Barnett et al. | 108/139 |
| 3,332,656 | 7/1967 | Johnson, Jr. et al. | 108/139 |
| 3,646,896 | 3/1972 | Derujinsky et al. | 108/139 |
| 3,713,619 | 1/1973 | Marty | 108/139 |
| 4,258,630 | 3/1981 | Jorgensen et al. | 108/139 |
| 4,640,486 | 2/1987 | Neville | 108/103 |
| 4,755,099 | 7/1988 | Belveal | 414/911 |

OTHER PUBLICATIONS

Advertisement for "Paper Puck", Litho Research, Ltd., Mar. 1993.

Advertisement for a Roll Handling System, *Southern Graphics*, Nov. 1990, p. 19.

*Primary Examiner*—Karen B. Merritt
*Assistant Examiner*—Gregory A. Morse
*Attorney, Agent, or Firm*—Webb Ziesenheim Bruening Logsdon Orkin & Hanson

[57] ABSTRACT

A lightweight turntable for use in manipulating printing paper rolls of 1,500 pounds in weight or more is disclosed. The device includes a stationary base plate having one or more circular bearing raceways formed therein. A rotatable upper plate having matching raceways is fitted to the base plate with a plurality of ball bearings positioned in the upper and lower race tracks. The upper plate includes a raised circular bead or an elevated surface to direct the loading of the paper roll from the peripheral edge of the stationary base to provide easy turning of the roll. The device is manually carried and spotted at selected turning locations, as needed, to move a paper roll to a desired location.

17 Claims, 4 Drawing Sheets

TURNTABLE FOR MANIPULATING PAPER ROLLS

The present invention is a continuation-in-part of U.S. patent application Ser. No. 08/035,442 filed on Mar. 23, 1993, now abandoned.

BACKGROUND OF THE INVENTION

1. Field of the Invention

The present invention relates generally to article handling and, more particularly, to low-profile turntables for manipulating large paper rolls.

2. Prior Art

In the printing industry, it is frequently necessary to move large rolls of paper along the floor to the printing presses. Such paper rolls can weigh 1,500 pounds or more. When paper rolls are rolled along the floor, it is oftentimes necessary to turn the roll about a vertical axis in order to travel around aisle corners, machinery and the like. Typically, one or two workmen manually turn the heavy roll a given amount as the roll rests directly on the floor. This manual manipulation activity requires a good deal of strength and sometimes causes undue stress on the workman's lower back. In addition, the turning maneuver can also damage the outer wraps of paper on the roll. Of course, it also goes without saying that work-related back injuries are to be avoided if possible because of the pain and possible disability to the worker, as well as the attendant expense to the employer.

Various attempts have been contemplated for addressing the manual turning of large paper rolls. One approach has been to roll the paper roll onto a holder which has either a lower coefficient of friction with the ground or less contact surface area or both. The aluminum PAPER PUCK® product manufactured by Litho Research, Ltd. utilizes this approach. However, this still has significant drawbacks. The amount of force required to turn a paper roll on the holder remains significant, and the holder does not eliminate damage to the outer wrap of paper.

A better approach has been the use of relatively narrow steel turntables upon which the paper roll may be rolled and easily turned. The ROLLTATOR product sold by Poly Systems Company discloses the use of such a turntable in turning paper rolls. The ROLLTATOR product includes a single race of ball bearings near the outer perimeter of the turntable. The known paper roll turntables, such as the ROLLTATOR product, have several drawbacks. Most significantly, the turntable cannot consistently and repeatedly handle paper rolls in excess of 1,500 pounds. The turntable can become significantly less effective or completely inoperative with such repeated heavy use. Additionally, the top surface and side profile of these known paper roll turntables may cause damage to the outer wrap of paper on the paper roll.

The present invention is directed toward an improved paper roll turntable which permits the roll to be turned easily by one person and with very little force which can be consistently and repeatedly used for even the heaviest rolls. The roll turntable and method of the present invention reduce back stress and reduce the risk of back-related injuries heretofore caused by turning heavy paper rolls without the use of an effective turntable. These advantages are obtained in a relatively inexpensive and portable device of minimal weight, yet suitable for repeatedly turning paper rolls weighing in excess of 1,500 pounds.

SUMMARY OF THE INVENTION

Briefly stated, the roll manipulation device of the present invention comprises a base plate having at least one and preferably a plurality of circular lower raceways formed therein. A plurality of ball bearings is positioned in each raceway. The base plate preferably has an outer peripheral edge spaced outwardly from the outermost raceway. The peripheral edge is circular in a top plan view and comprises an upwardly formed, annular edge carrying an inwardly formed, annular horizontal lip portion. The upwardly formed edge may be curved or may preferably be a ramp-shaped structure with an inwardly tapered side. An upper plate having one or a plurality of circular upper raceways formed therein is positioned above the lower plate with each upper raceway also engaging the ball bearings. Where a single upper raceway is provided, the upper raceway defines a generally raised bead around the upper plate near an outer peripheral edge thereof. With a plurality of upper raceways, the upper surface of the upper plate is substantially flat and at a level higher than the upwardly formed edge of the base plate. An annular, outer peripheral edge of the upper plate is positioned beneath the horizontal lip portion of the lower base plate which functions to retain the upper plate in alignment with the base plate and also keeps foreign matter from entering the interior space between the plates and the bearing raceways. The assembled device is relatively thin, less than 1 inch, preferably about ½ inch or less, which permits the rolling of a paper roll thereon with little resistance and no damage to the paper roll. The raised bead around the upper plate may serve to aid in positioning a paper roll on the upper plate and to retain the roll once in place. The raised bead may also deform portions of the bottom of the paper roll a slight distance upwardly, thus avoiding engagement with the stationary peripheral lip portion of the lower base plate. This permits the device to freely turn with a minimum force which otherwise would not be possible if the paper roll is in contact with the stationary lip. The device may also include a ball bearing retainer device, preferably in the form of an inner ring or plate positioned between the upper and base plates having an outer diameter the same as or slightly less than an inner diameter of the innermost bearing raceway such that the retainer ring or plate prevents the ball bearings from leaving the innermost raceway and entering the interior of the device.

A method of manipulating a paper roll according to the instant invention includes the steps of providing a turntable, as above described, and positioning the device on the plant floor adjacent a paper roll. The paper roll is then rolled in a direction perpendicular to its roll axis onto the turntable. The paper roll is rotated a desired amount while resting on the turntable to assume a new rolling direction. The previously turned paper roll is then rolled further and subsequently turned at selected locations until a final destination is reached. The turntable may be moved by the workman to each new location simply by grasping the device and carrying it. This is an easy task due to the relatively small size and light weight of the turntable.

DETAILED DESCRIPTION OF THE INVENTION

Figure 1:
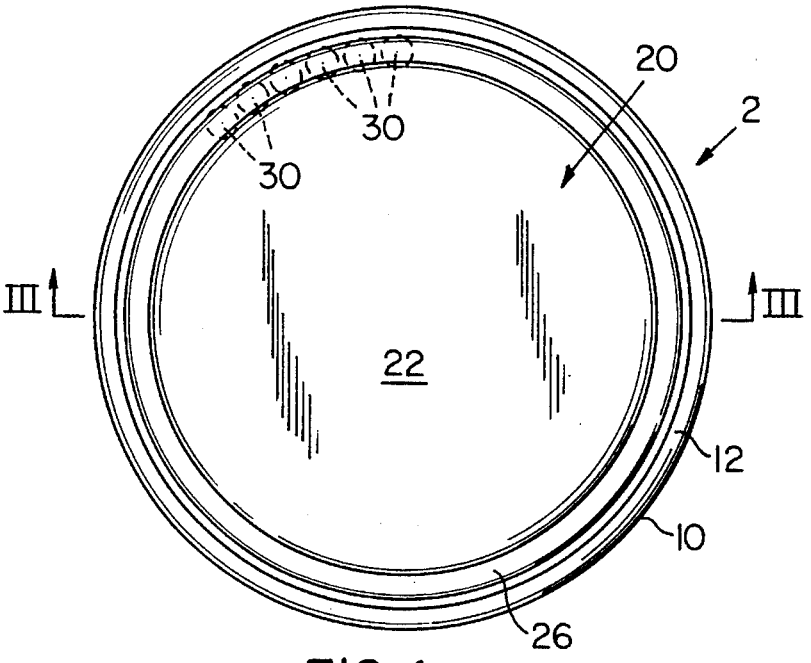
FIG. 1 is a top plan view of a turntable according to a first embodiment of the present invention.
Figure 2:
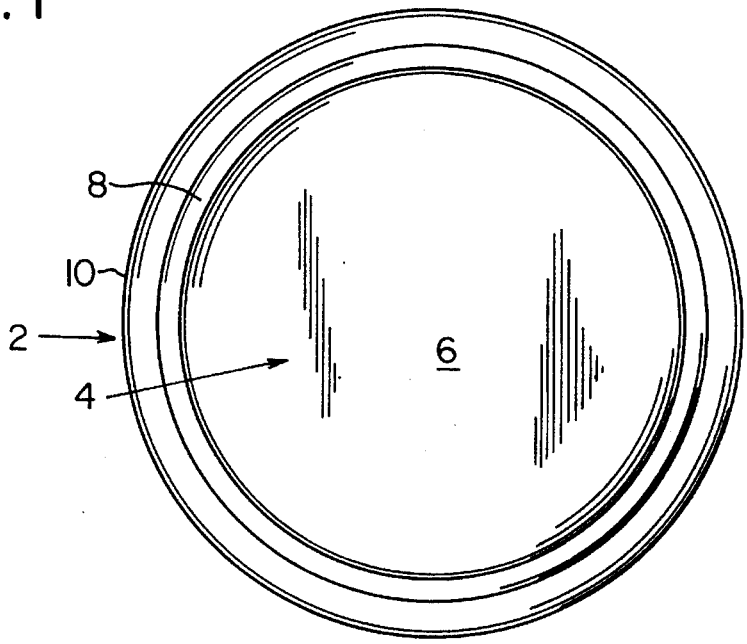
FIG. 2 is a bottom plan view of the turntable of FIG. 1.
Figure 3:
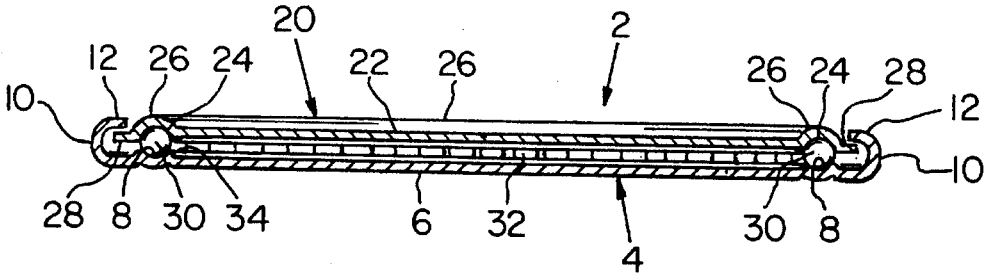
FIG. 3 is a cross-sectional side view of the turntable of the invention taken along line III—III of FIG. 1.

Referring now to the drawings, identical elements are identified by identical reference numerals throughout the various figures. A first embodiment of the turntable of the present invention, designated generally by reference numeral 2, is depicted in FIGS. 1–3. The low-profile turntable 2 includes a base plate 4 having a flat central region 6 and a lower raceway 8 formed therein. The raceway 8 is circular in shape in plan view. The base plate 4 further includes an upwardly extending, curved peripheral edge 10, spaced outwardly from the lower raceway 8. The peripheral edge 10 carries an inwardly formed, horizontally extending lip 12.

An upper plate 20 is rotatably positioned above the base plate 4 and has a flat central region 22 and an upper raceway 24 formed therein. The upper raceway 24 also has a circular shape in plan view. The upper raceway 24 is complementary in shape and size to the lower raceway 8, which together, define in cross section, a partially circular confining space. The formation of the upper raceway 24, as seen in FIG. 3, causes a circular raised bead 26 to, likewise, exist in the upper plate 20. The upper plate 20 also carries an outwardly extending, peripheral edge 28 which is positioned beneath the inwardly formed lip 12 of the base plate 4.

A plurality of spherical ball bearings 30 is positioned between the lower and upper raceways 8 and 24, respectively, to permit the upper plate 20 to freely rotate on the stationary base plate 4. It will be observed in FIG. 3 that the curved peripheral edge 10 and lip 12 of the stationary base plate 4 mechanically retain the peripheral edge 28 of the upper plate 20 both in the horizontal and vertical directions and also prevent foreign matter from entering the interior region and fouling the bearings 30. The curved peripheral edge 10, along with the low profile of the turntable 2, allow for little resistance when a paper roll is rolled thereon. The upper plate 20 and base plate 4 are preferably fabricated from steel sheet metal of about 20 gauge thickness. The ball bearings 30 may be ¼ inch in diameter. The ball bearings 30 are preferably loose but in contact with one another around the raceways to assure constant bearing support therearound. The assembled turntable 2 is on the order of about 5/16 inch thick and about 1 foot in diameter, weighing only about 2 pounds. Needless to say, the turntable 2 is easily carried and spotted wherever a roll turn is required.

A circular plate 32 may be positioned with the interior space between the upper plate 20 and the base plate 4 to act as a bearing retainer, although this is not required. The retainer plate 32 has a diameter the same as or slightly smaller than an inside diameter of the raceways 8 and 24 so that an outer, peripheral edge 34 of the retainer plate 32 barely touches the ball bearings 30. In this manner, the bearings 30 are prevented from leaving the confined raceway and entering into the interior portion between the plates 4 and 20.

It is important in the proper functioning of the turntable 2 that the paper roll not bear heavily against the lip 12 and curved peripheral edge 10 of the stationary base plate 4. If such engagement occurs, it becomes very difficult to rotate the upper plate 20 due to the considerable weight of the paper roll bearing against the stationary elements. In order to prevent or minimize this contact, the circular bead 26 is provided around the perimeter of the upper plate such that the bead 26 directs the paper roll upwardly in the peripheral region of lip 12.

Figure 4:
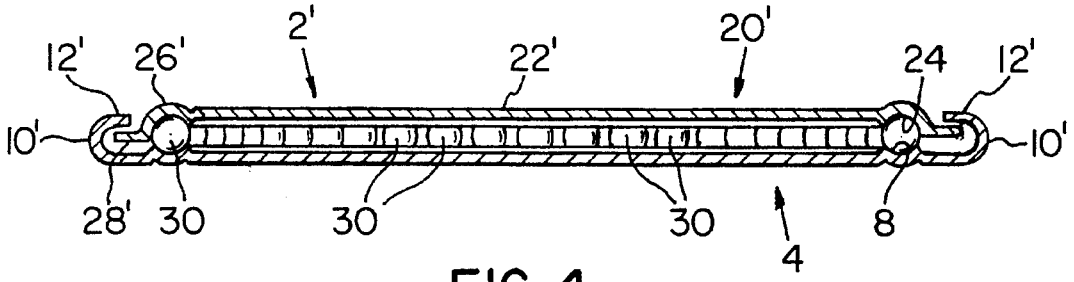
FIG. 4 is a cross-sectional side view similar to FIG. 3 of a second embodiment of the turntable of the present invention.

A similar result is also accomplished in the slightly modified turntable 2' shown in FIG. 4. The upper plate 20' has a flat central region 22' which is elevated slightly above the lip 12 of the stationary base plate 4. The configuration of the upper plate 20', including the flat central region 22', of FIG. 4 is quite effective in preventing the paper roll from exerting any appreciable weight on the stationary lip 12 which would otherwise make turning of the roll more difficult.

Figure 5:
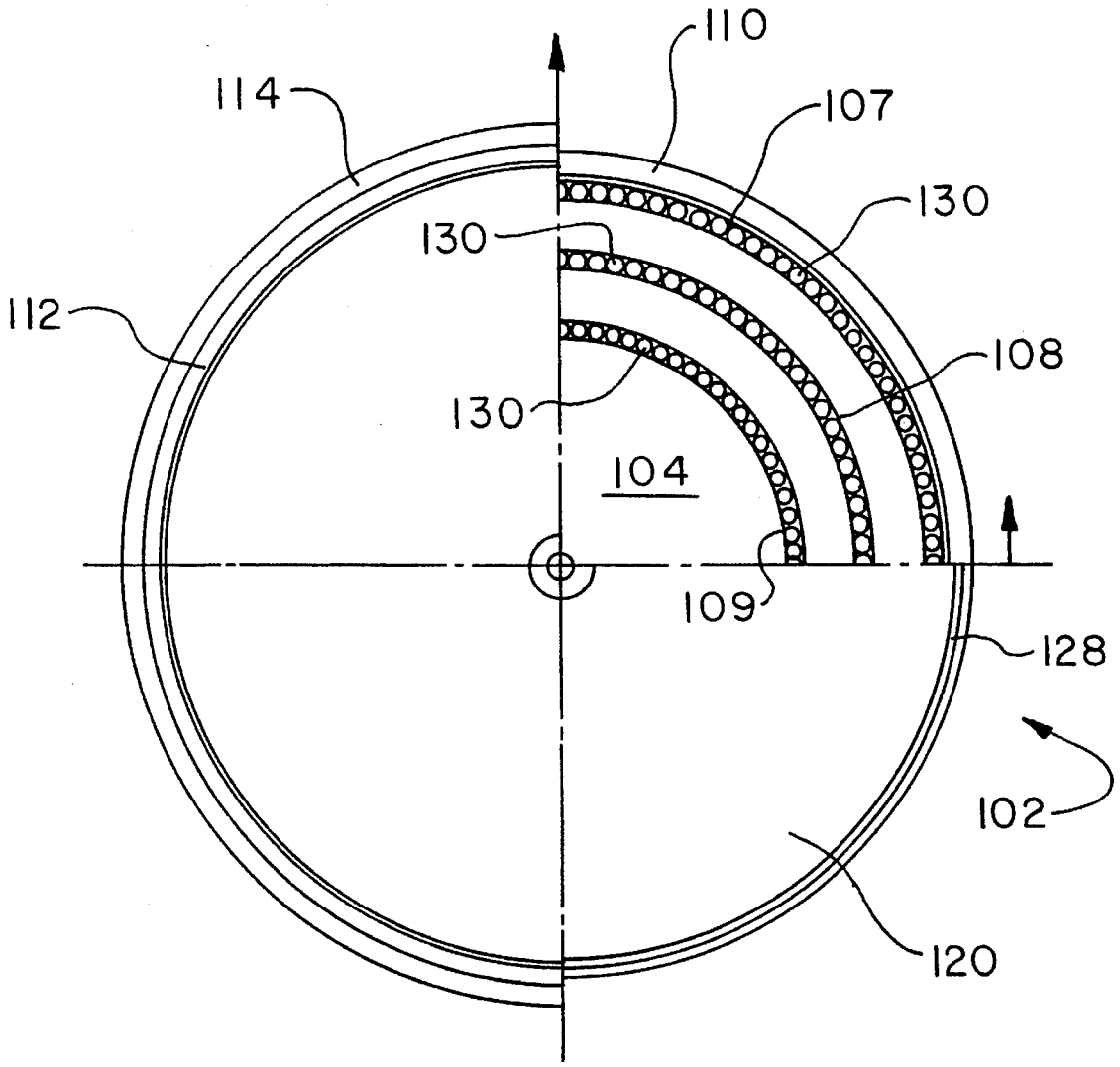
FIG. 5 is a top plan view, partially in section, of a turntable according to a third embodiment of the present invention.
Figure 6:
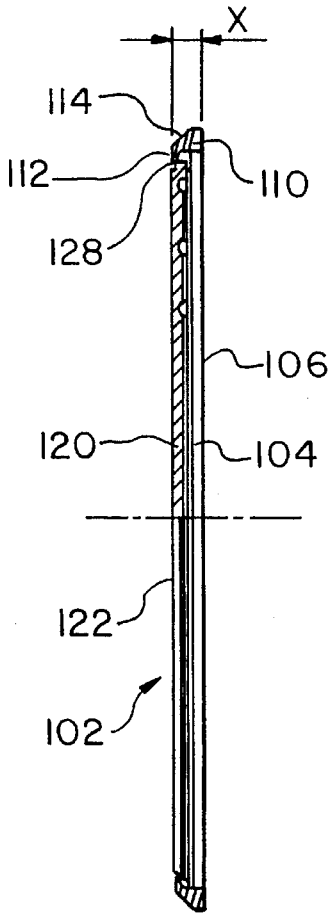
FIG. 6 is a side view, partially in section, of the turntable of FIG. 5.
Figure 7:
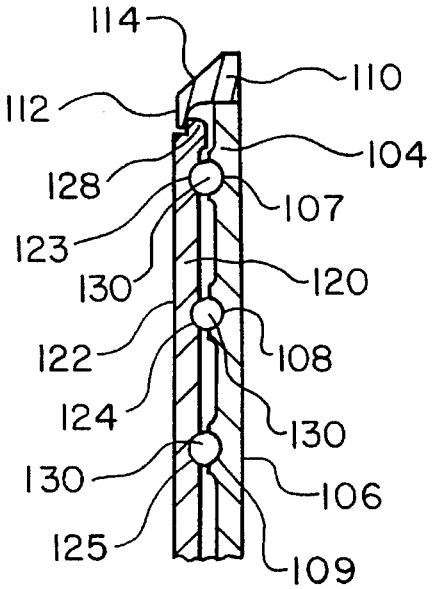
FIG. 7 is an enlarged view of a portion of the turntable shown in FIG. 6.

A further preferred embodiment of the present invention is shown in FIGS. 5–7. The low-profile turntable 102 shown in FIGS. 5–7 is specifically adapted for repeated use with paper rolls weighing greater than 1,500 pounds, although the turntable 102 is also very effective for paper rolls weighing considerably less. The turntable 102 is similar to the turntables 2 and 2' discussed above in connection with FIGS. 1–4. The turntable 102 includes a base plate 104 having a substantially planar bottom surface 106 and three lower raceways 107, 108 and 109 formed therein. The base plate further includes an upwardly extending peripheral edge 110 spaced radially outwardly from the outermost lower raceway 107. The peripheral edge 110 includes an inwardly formed, horizontally extending lip 112 at an uppermost portion of the peripheral edge 110. The peripheral edge 110 also includes a substantially planar, inwardly tapered side 114, whereby the peripheral edge 110 forms a ramp-like structure.

An upper plate 120 is rotatably positioned above the base plate 104 and has a substantially flat upper surface 122 which is positioned above the lip 112. The upper plate 120 includes three upper raceways 123, 124 and 125 which correspond in shape and position to lower raceways 107, 108 and 109 to form three bearing raceways, as shown in FIG. 7. The upper plate 120 also carries an outwardly extending peripheral edge 128 which is positioned beneath the inwardly formed lip 112 of the base plate 104. The lip 112 operates in the same manner as lip 12 in FIGS. 1–4 to secure the upper plate 120 and prevent foreign matter from entering the interior of the turntable 102. A grease fitting 129 is positioned at the center of the turntable 102 to allow for easy lubrication of the interior of the turntable 102.

A plurality of spherical ball bearings 130 is positioned between each pair of corresponding lower and upper raceways 107 and 123, 108 and 124, and 109 and 125, respectively, to permit the upper plate 120 to freely rotate on the stationary base plate 104. A circular bearing retaining plate (not shown) may also be used between the upper plate 120 and the base plate 104 and the innermost bearing raceways 109 and 125, substantially the same as plate 32 in FIGS. 1–4. It would also be possible to use annular-shaped bearing retaining plates (not shown) between the remaining raceways.

The turntable 102 has several distinct advantages making it particularly well adapted for repeatedly turning heavy paper rolls without damage to itself or the paper roll. First, the number and positioning of the bearing raceways make the turntable 102 better suited for heavy paper rolls than other turntables. Specifically advantageous is the provision of a plurality of bearing raceways between a position about halfway from the center of the upper plate 120 to the outer perimeter of the upper plate 120. As best shown in FIG. 5, the innermost bearing raceway, formed of upper raceway 125 and lower raceway 109, is positioned about halfway between the center and outer peripheral edge of the upper plate 120. The outermost bearing raceway 107 and 123 is adjacent the peripheral edge of the upper plate 120 and the remaining bearing raceway 108 and 124 is midway between the other two bearing raceways. The three bearing raceways effectively distribute the weight of the heavy paper roll and still allow for a lightweight turntable 102. The three bearing raceways provide a weight capacity of the turntable 102 of about 2 to 3 tons.

A second distinct feature of the turntable 102 is the flat upper surface 122 positioned above the lip 112 which will keep the paper roll from contacting the upper lip 112 or peripheral edge 110 when positioned on the upper plate 120. The turntable 102 maintains a low profile with the distance, X, between the planar bottom surface 106 and the upper surface 122 being about ½ inch. The planar upper surface 122 will also minimize the damage to the outer wrap of the paper roll.

The turntable 102 is also designed to allow for easy movement of the paper roll onto the upper plate 120 without damage to the paper roll. The ramp-like peripheral edge 110 formed by inwardly tapered planar side 114 allows the paper roll to be easily rolled onto the turntable 102 while the planar bottom surface 106 will prevent any movement or wobble of the turntable 102 during such positioning of the paper roll. Wobbling or tilting of the turntable during positioning of the paper roll can cause damage to the paper roll or a sliding of the turntable to an unwanted position. The turntable 102 effectively eliminates this problem.

In a typical printing shop, it is not uncommon to use paper rolls weighing 1,500 pounds or more. The paper rolls are usually moved to the printing press by rolling the paper roll along the plant floor. That task is not overly difficult until a turn or change of rolling direction of the paper roll is required. Then, the roll must be turned about a vertical axis which necessarily requires a great amount of force when performed manually. The present invention eliminates the heretofore difficult and physically onerous task of manually manipulating heavy paper rolls.

Figure 8:
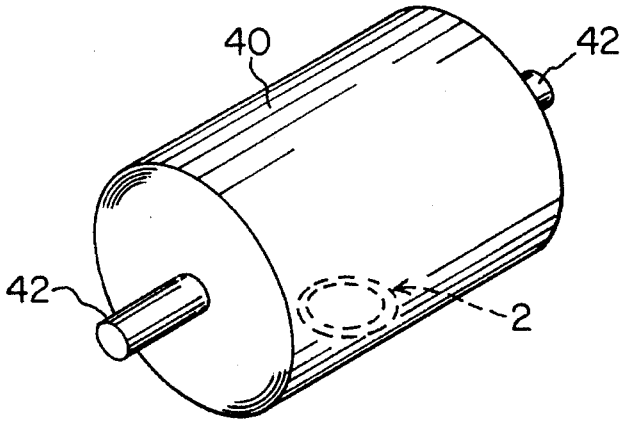
FIG. 8 is a perspective view of a paper roll positioned on a turntable of the present invention.
Figure 9:
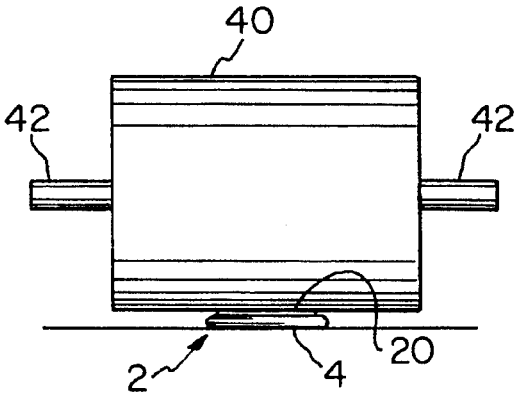
FIG. 9 is a side elevation view of a paper roll positioned/on a turntable of the invention.
Figure 10:
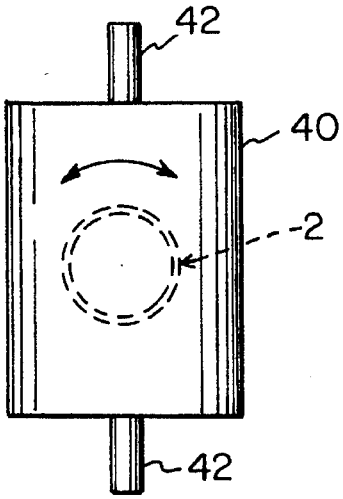
FIG. 10 is a top plan view of the paper roll and turntable depicted in FIG. 8.

As shown in FIGS. 8–10, a paper roll 40 on the order of 1,500 pounds or more is positioned on a turntable 2, 2' or 102. Due to the sheer weight of the paper rolls and the confining spaces usually found in print shops, it is difficult to turn the rolls when moving them along the shop floor. Heretofore, it has customarily been necessary to have two workmen manually rotate the heavy roll 40 to change direction as required when moving the roll from one location to another. In the method of the present invention, the turntable 2, 2' or 102 is spotted next to the paper roll 40 on the floor. A roll shaft 42 is positioned along a central axis of the roll 40 prior to loading the roll in a printing press. Generally the rolls, when being moved about the print shop floor, do not have a shaft 42 inserted therein. Whenever a change of direction is required, the paper roll 40 is rolled onto the spotted turntable 2, 2' or 102, as shown in FIGS. 8 and 9. As mentioned above, straight line rolling in a direction perpendicular to an axis of a roll shaft 42 is relatively easy compared with the roll turning maneuver and can be accomplished by one worker. Once the paper roll 40 is positioned onto the turntable 2, 2' or 102, the roll is easily rotated about a vertical axis to permit the roll to be moved around a corner or the like.

As stated above, each turntable 2, 2' or 102 is relatively small physically, measuring about 1 foot in diameter, with a low profile of ½ inch or less in thickness. As previously mentioned, the device is about 2 pounds and may easily be carried by one person and spotted wherever needed. The low profile of the turntable, coupled with the peripheral edge 10 or 110, provides negligible resistance to an approaching roll and allows almost effortless positioning of the paper roll thereon.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A low-profile turntable for manipulating paper rolls comprising:

a stationary base plate having at least one lower bearing raceway portion therein, and an upwardly extending, continuous, annular peripheral edge at a radially outermost portion of said base plate, said peripheral edge having an inwardly formed, continuous, annular peripheral lip thereon at an uppermost portion of said peripheral edge;

a rotatable upper plate having an upper bearing raceway portion therein for each said lower bearing raceway portion which combines to form a bearing raceway, said upper plate having an outwardly extending, continuous, annular peripheral edge positioned beneath said peripheral lip of said base;

a plurality of ball bearings rotatably positioned in each said bearing raceway to permit said upper plate to rotate relative to said stationary base plate when a paper roll is positioned on said upper plate; and a bearing retainer plate positioned between said base plate and said upper plate to keep said ball bearings in said bearing raceways.

2. The turntable of claim 1 including means associated with said upper plate adapted to minimize loading of the paper roll on a peripheral edge portion of the stationary base plate.

3. The turntable of claim 2 wherein the paper roll load minimizing means comprises a raised bead formed around said upper plate as a portion of one said upper raceway, said raised bead adapted to cause an upward deflection of said paper roll in a direction away from said peripheral lip of said stationary base plate.

4. The turntable of claim 2 wherein said paper roll load minimizing means comprises an upper plate having an elevated, central portion disposed at least within one said upper raceway which is spaced a distance above said peripheral lip of said stationary base plate.

5. The turntable of claim 1 wherein a plurality of bearing raceways is provided positioned between said peripheral edge of said upper plate and about halfway to the center of said upper plate.

6. The turntable of claim 1 wherein said base plate has a substantially flat bottom surface and said upwardly extending peripheral edge has an inwardly tapered flat side, whereby said peripheral edge forms a ramp structure.

7. A low-profile turntable for manipulating paper rolls comprising:

a stationary base plate having a plurality of circular, lower bearing raceway portions formed therein and further including a vertically extending, continuous, annular peripheral edge at a radially outermost portion of said base plate, said peripheral edge carrying an inwardly formed, horizontally extending, continuous, annular peripheral lip thereon;

a rotatable upper plate having a plurality of circular upper raceways formed therein which align with said plurality of lower bearing raceway portions to form a plurality of bearing raceways, said upper plate carrying a horizontally extending, continuous, annular peripheral edge positioned beneath said peripheral lip of said base plate;

a plurality of ball bearings positioned in each respective one of said bearing raceways to permit said upper plate to rotate relative to said base plate when a paper roll is positioned on said upper plate; and means associated with the upper plate to minimize paper roll loading on said peripheral lip of said base plate.

8. The turntable of claim 7 wherein said base plate has a substantially flat bottom surface and said upwardly extending peripheral edge has an inwardly tapered flat side, whereby said peripheral edge forms a ramp structure.

9. The turntable of claim 7 wherein said paper roll load minimizing means comprises said upper plate having an elevated, flat upper surface which is spaced a distance above said peripheral lip of the stationary base plate.

10. The turntable of claim 7 wherein said plurality of bearing raceways is positioned between said peripheral edge of said upper plate and a position halfway to the center of said upper plate.

11. The turntable of claim 10 wherein three bearing raceways are provided, a first halfway to said center of said upper plate, a second adjacent said peripheral edge of said upper plate, and a third about midway between said first and said second bearing raceways.

12. The turntable of claim 11 further including a grease fitting at said center of said upper plate.

13. The turntable of claim 12 wherein said paper roll load minimizing means comprises said upper plate having an elevated, flat upper surface which is spaced a distance above said peripheral lip of the stationary base plate.

14. The turntable of claim 13 wherein said base plate has a substantially flat bottom surface and said upwardly extending peripheral edge has an inwardly tapered flat side, whereby said peripheral edge forms a ramp structure.

15. A lightweight, low-profile, portable turntable for manipulating heavy paper rolls about an axis orthogonal to the centerline of the paper rolls, said turntable comprising:

a base plate having a flat planar bottom surface and a vertically extending, annular peripheral edge with an annular, inwardly formed, horizontally extending peripheral lip attached to an upper end of said peripheral edge and an inwardly tapered side whereby said peripheral edge forms a ramp structure, said base plate including a first lower bearing raceway portion formed adjacent said peripheral edge, a second lower bearing raceway portion formed about halfway to the center of said turntable, and a third lower bearing raceway portions positioned between said first and second lower bearing raceway portions;

a rotatable upper plate having an annular peripheral edge positioned beneath said peripheral lip and a planar upper surface spaced a distance above said peripheral edge of said base plate, said upper plate including first, second and third upper bearing raceway portions which combine with said first, second and third lower bearing raceway portions to form first, second and third bearing raceways; and a plurality of ball bearings in each said bearing raceway to permit rotation of said upper plate relative to said base plate, whereby the paper roll may be rolled up said tapered side of said base plate peripheral edge onto said upper surface of said upper plate wherein the paper roll is spaced from said base plate peripheral edge and may be rotated about the axis orthogonal to the centerline of the paper roll by rotation of said upper plate relative to said base plate.

16. The turntable of claim 15 further including a grease fitting in said center of said turntable, whereby the interior of said turntable may be easily lubricated.

17. The turntable of claim 16 wherein the distance between said upper surface and said bottom surface is about ½ inch.

* * * * *